United States Patent [19]

Belmont

[11] 3,979,122

[45] Sept. 7, 1976

[54] ADJUSTABLY-WEIGHTED GOLF IRONS AND PROCESSES

[76] Inventor: Peter A. Belmont, 7 White Birch Ridge, Weston, Conn. 06608

[22] Filed: June 13, 1975

[21] Appl. No.: 586,598

[52] U.S. Cl. ..... 273/171

[51] Int. Cl.[2] ..... A63B 53/04

[58] Field of Search ..... 273/77 R, 77 A, 79, 273/167–175

[56] References Cited

UNITED STATES PATENTS

| | | | |
|---|---|---|---|
| 1,289,192 | 12/1918 | Klin | 273/169 |
| 1,453,503 | 5/1923 | Holmes | 273/171 |
| 1,497,578 | 6/1924 | Mothersele | 273/172 |
| 1,840,924 | 1/1932 | Tucker | 273/171 |
| 1,983,196 | 12/1934 | Spiker | 273/171 X |
| 2,231,847 | 2/1941 | Dickson et al. | 273/167 F X |
| 2,332,342 | 10/1943 | Reach | 273/171 |
| 2,998,254 | 8/1961 | Rains et al. | 273/171 |
| 3,191,936 | 6/1965 | Guier | 273/171 X |
| 3,466,047 | 9/1969 | Rodia et al. | 273/171 |
| 3,606,327 | 9/1971 | Gorman | 273/171 X |
| 3,652,094 | 3/1972 | Glover | 273/171 |
| 3,840,231 | 10/1974 | Moore | 273/171 X |
| 3,845,960 | 11/1974 | Thompson | 273/171 |

FOREIGN PATENTS OR APPLICATIONS

| | | | |
|---|---|---|---|
| 5,368 | 3/1894 | United Kingdom | 273/171 |
| 440,379 | 12/1935 | United Kingdom | 273/171 |

*Primary Examiner*—Richard J. Apley
*Attorney, Agent, or Firm*—Thomas L. Tully

[57] ABSTRACT

Improved golf clubs having metal heads, conventionally known as "irons", and processes for producing such "irons" in such a way that the swing weight of each "iron" produced can be varied within very close tolerances and/or the distribution of the weight of the metal head, i.e. the balance thereof, can be rendered adjustable by the user so as to overcome problems of "slicing" or "hooking" of the golf ball during use.

9 Claims, 5 Drawing Figures

ADJUSTABLY-WEIGHTED GOLF IRONS AND PROCESSES

The present invention relates to the production of golf irons which are adjustable with respect to swing weight and with respect to heel-toe balance.

It has been proposed in the past to provide golf irons with weight-receiving bores whereby the swing weight of the iron could be varied from club to club to produce a matched set of irons. It has also been proposed to provide golf irons with weight-receiving bores in the heel and toe sections whereby the relative adjustment of the position of heavy and light weights within such bores causes an adjustment of the heel and toe balance of the irons.

Such prior proposals have been unsatisfactory for a number of reasons. In some cases the weight of the iron has been substantially reduced in the area immediately behind and below the "sweet spot" or ball-engaging portion of the face plate. In other cases the adjustable weight incorporated in the iron is movable and not fixed in place, such as metal powder, pellets or slugs which interfere with the feel and sound of the club hitting the ball and result in distortion of the shape of the bores or of the weights. In yet other cases the weight adjustments which can be made are relatively minor and/or it is not possible to adjust the weight of the club in the area immediately behind and below the "sweet spot".

It is the principal object of the present invention to provide improved golf irons which have adjustable swing weights, adjustable heel-toe balance and an adjustable weight immediately behind and below the "sweet spot".

It is another object of this invention to provide improved golf irons which contain one or more adjustable weights which are fixed in position during use and which may be adjusted in position in simple manner to alter the heel-toe balance without the necessity of removing any weights from the iron.

It is still another object of this invention to provide improved golf irons in which the weight of the iron, immediately behind and below the "sweet spot" can be increased or reduced, as desired, to alter the feel of the club and the tendency to loft the ball.

These and other objects and advantages of the present invention will be apparent to those skilled in the art in the light of the present disclosure, including the drawing in which.

Figure 1:
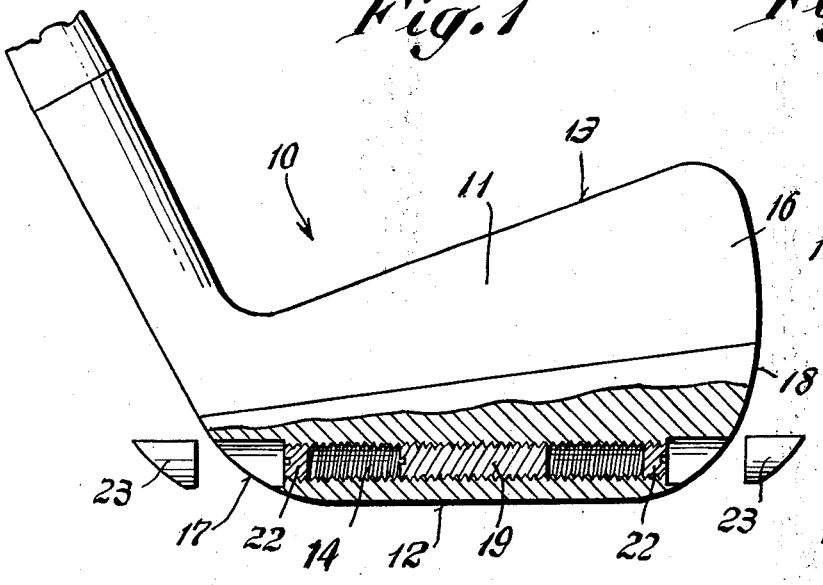
FIG. 1 is a partial cross-section view of the golf iron of FIG. 2 taken along the line 1–1.
Figure 2:
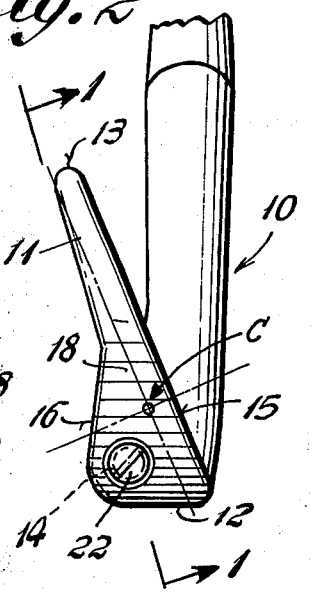
FIG. 2 is a toe-end view of the golf iron of FIG. 1 illustrating the relative position of the core C or center of gravity of the blade and the four quadrants of the blade relative to the core C.

The drawing illustrates embodiments of the present invention as applied to two differently-shaped "irons". In FIGS. 1 and 2, the "iron" 10 is of the more conventional shape having a relatively thin flat blade 11 which is only slightly thicker and heavier adjacent the sole 12 than the upper 13. The invention is characterized by providing a hollow threaded bore 14 through the blade, parallel to the surface of the face 15 or to the rear surface 16 and preferably parallel to the surface of the sole 12, and introducing into said bore a threaded insert which is fixed in place at any desired adjustable location and which has a predetermined weight so that the final iron will also have a predetermined swing weight.

The bore 14 preferably is located as close as practical to the bottom or sole surface 12 and to the rear surface 16 of the blade 11 in the lower rear quandrant so that the weight introduced therein is concentrated below and to the rear of the core C or center of gravity of the iron head, as shown by FIG. 2, and below the center of the striking face 15 of the iron, or its "sweet spot". Increased weight in this area causes the club to provide increased lift and distance to the ball being hit.

The bore 14 is cylindrical and extends completely through the iron head from the heel section 17 to the toe section 18 and is threaded so as to engage one or more threaded weights 19 which are of predetermined weight and which are screwed into the bore to the desired location to provide the desired weight distribution. If a single weight is used, the weight 19 is screwed into a central location, as shown in FIG. 1, and then its position is adjusted to the left or right to shift the weight distribution towards the heel or toe as desired. Weight distribution towards the heel will tend to overcome the tendency of a right-handed user to hook the ball (hit it to the left) while weight distribution towards the toe will tend to overcome the tendency of a right-handed user to slice the ball (hit it to the right).

Figure 3:
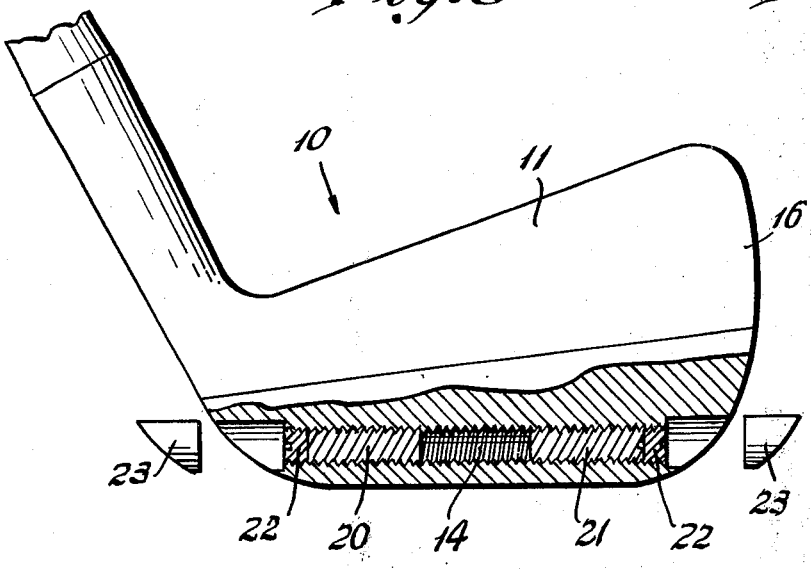
FIG. 3 is a partial cross-section view of the golf iron of FIG. 4.

If two weights are used, as shown in FIG. 3, separate threaded weights 20 and 21 are screwed into the heel and toe entrances of the bore 14, their total weight being as required to provide the predetermined uniform swing weight and their relative positions in the heel and toe sections of the bore being such as to provide the weight distribution necessary to overcome the tendency to hook or slice the ball. Obviously a greater number of threaded weights may be used, including threaded discs of different weights, so as to enable minor changes in the weight distribution whereby the user can experiment with gradual adjustments until his problem is overcome. However the use of one or two weights is preferred for ease of use and control.

The bore 14 is preferably sealed by means of threaded caps 22 provided with exposed slots or hexagonal recesses adapted to permit their removal by a screwdriver, male wrench, or the like. The weights 19, 20 and 21 are also provided with similar means for enabling them to be removed or adjusted in position. If desired finishing plugs 23, as shown, can be inserted into the ends of the bore, over the caps 22, to provide a finished appearance.

Figure 4:
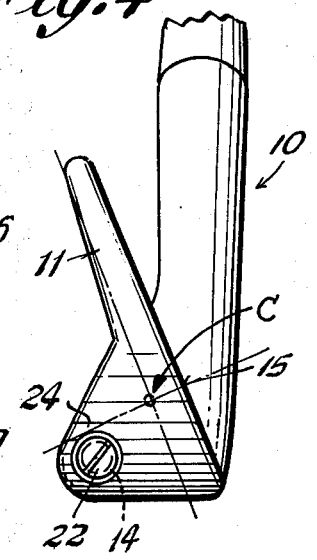
FIG. 4 is a toe-end of the golf iron of FIG. 3 illustrating the relative position of the core C or center of gravity of the blade and the four quadrants of the blade relative to the core C and FIG. 5 is a perspective view of a group of threaded inserts having different known weights for use according to the present invention.

FIGS. 3 and 4 of the drawings illustrate a more preferred golf club iron which is similar to that of FIGS. 1 and 2 except that the blade is substantially thicker at the sole area than at the upper area of the blade so that a substantial part of the weight of the metal blade is located below and to the rear of the center of gravity of the blade. Such blades, unmodified, are conventional in the art.

Like numerals are used to define like areas of the irons of FIGS. 3–4 and FIGS. 1–2 and the foregoing description relative to the embodiment of FIGS. 1 and 2 applies equally to FIGS. 3 and 4. The only important differences are that the iron of FIGS. 3 and 4 has a greater substantial weight mass 24 at the rear surface 16 and the bore 14 is located in said weight mass 24 as far rearward of the face 15 as practical with a weight 20 and 21 positioned in each section of the bore 14.

As is apparent to those skilled in the art, the heel-toe balance of the present irons can be adjusted in simple manner by screwing the weight 19 or weight 20 towards the heel to increase the weight of the iron in the heel area, or by screwing the weight 19 or weight 21 towards the toe to increase the weight of the iron in the toe area. No weight need be removed from the iron, with attendant risk of loss or confusion regarding location in which to be reinserted.

Figure 5:
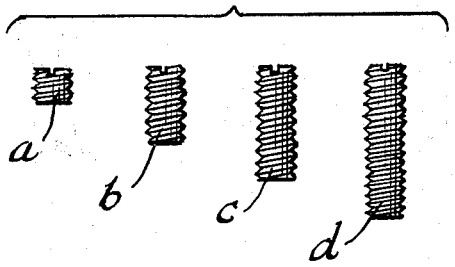

Furthermore the adjustable weight or weights are concentrated in the area immediately behind and below the "sweet spot" of the iron in the lower rear quadrant of the iron, relative to its core C center of gravity, as illustrated by FIGS. 2 and 4 of the drawing. The concentration of the adjustable weight in this location has been found to provide the greatest possible control over the balance of the iron and its tendency to loft the golf ball, i.e. tendency to hit it high. Thus heavier weights such as brass weights can be used to increase the weight in this quadrant, thus increasing loft, while lighter weights such as aluminum can be used to decrease loft. Generally steel weights are used to provide a combination of good loft and good distance. Thus the selection of one or a matched pair of threaded inserts from a group of inserts having a precisely known weight relative to each other, such as weights *a*, *b*, *c* and *d* of FIG. 5, enables the user to vary the swing weight of the iron upwards or downwards, as desired, while adjusting the heel-toe balance of the iron by positioning one or both of the inserts towards the heel or toe as desired. For instance a pair of steel inserts a of FIG. 5, having the dimensions ¼ inch by ¼ inch, will provide a swing weight of D-0 when inserted into the empty bore of a golf iron having a swing weight of C-9. The use of a pair of steel inserts *b*, ¼ inch by ½ inch, provides a swing weight of D-1 ½. The use of a pair of steel inserts *c*, ¼ inch by 3/4 inch provides a swing weight of D-3, while a pair of steel inserts *d*, ¼ inch by 1 inch, provides a swing weight of D-4. Inserts having intermediate lengths provide intermediate swing weights, i.e. 5/16 inch length inserts provide a swing weight of D-1 and 5/8 inch length inserts provide a swing weight of D-2 ½.

The threaded inserts may be formed of steel but heavier metals, particularly rust-resistant metals such as brass, are preferred to provide greater increases in club weight and greater resistance to corrosion. The caps 22, if present, preferably are also formed of corrosion-resistant material, such as brass.

The threaded bore 14 is located in the sole section of the iron, preferably parallel to the underside of the sole surface 12 which is generally flat, as illustrated by FIGS. 1 and 3. The sole section is the thickest and heaviest section of the blade. The bore may be parallel to the face surface of the blade or parallel to the rear surface of the blade or may extend from the narrower heel section to a point midway between the face and rear surfaces at the toe section of the blade. Similarly the bore may extend from the heel section, from a point adjacent the sole surface 12, on a slightly upward incline and open at the toe section at a slightly greater height from the sole surface 12.

Variations and modifications may be made within the scope of the claims and portions of the improvements may be used without others.

I claim:

1. A golf iron comprising a blade containing means for adjusting the swing weight, the heel-toe balance and the lift- and distance-imparting properties thereof, said blade having a core comprising its center of gravity, a heel section and a toe section on opposite sides of said core, a relatively thin upper section extending from said toe section to said heel section above said core and a substantially thicker sole section extending from said toe section to said heel section below said core, a flat ball-engaging face surface between said heel, toe, upper and sole sections in front of said core and a rear surface between said heel, toe, upper and sole sections to the rear of said core, said iron having its greatest thickness in said sole section, a threaded cylindrical bore completely through said sole section adjacent but spaced from the undersurface of said sole section and the rear surface of said blade, said bore extending from said heel section to said toe section, below and to the rear of the core in the lower rear quadrant of the blade, and at least one threaded insert having a predetermined weight selected from a group of threaded inserts having different known weights engaged within said bore as the sole weight adjustment therein and providing said golf iron with a predetermined desired swing weight and predetermined lift- and distance- imparting properties, and located at a predetermined position within said bore to provide said golf iron with a predetermined desired heel-toe balance.

2. A golf iron according to claim 1 in which said bore extends substantially parallel to said face surface.

3. A golf iron according to claim 1 in which the undersurface of said sole section is relatively flat and said bore extends substantially parallel to said undersurface.

4. A golf iron according to claim 1 in which said rear surface is relatively flat and said bore extends substantially parallel thereto.

5. A golf iron according to claim 1 in which two said threaded inserts are engaged within said bore, one adjacent the heel section and the other adjacent the toe section of said blade.

6. A golf iron according to claim 1 in which said inserts are heavier than iron.

7. A golf iron according to claim 1 in which said threaded bore is provided with end closures in said heel and toe sections.

8. A process for producing a golf iron having an adjustable swing weight, an adjustable heel-toe balance and adjustable lift-and distance- imparting properties which comprises providing a golf iron having a blade having a core comprising its center of gravity, a heel section and a toe section on opposite sides of said core, a relatively thin upper section extending from said toe section to said heel section above said core and a substantially thicker sole section extending from said toe section to said heel section below said core, a flat ball-engaging face surface between said heel, toe, upper and sole sections in front of said core and a rear surface between said heel, toe, upper and sole sections to the rear of said core, said iron having its greatest thickness in said sole section, cutting a cylindrical bore completely through said sole section adjacent but spaced from the under-surface of said sole section and the rear surface of said blade, said bore extending from said heel section to said toe section, below and to the rear of the core in the lower rear quadrant of the blade, forming a thread within said bore, and screwing at least one threaded insert selected from a group of such inserts having different known weights into said bore, as the sole weight adjustment therein, the weight of said insert providing said iron with a predetermined swing weight and predetermined lift- and distance-imparting properties, and the location of said insert within said bore providing said iron with a predetermined heel-toe balance.

9. Process according to claim 8 in which two threaded inserts are screwed into said bore from opposite directions.

* * * * *